US007578360B2

(12) United States Patent
Haughom

(10) Patent No.: US 7,578,360 B2
(45) Date of Patent: Aug. 25, 2009

(54) DYNAMIC DAMPER FOR USE IN A DRILL STRING

(76) Inventor: Per Olav Haughom, Høgåsen 12, Tonstad (NO) N-4440

( * ) Notice: Subject to any disclaimer, the term of this patent is extended or adjusted under 35 U.S.C. 154(b) by 301 days.

(21) Appl. No.: 10/548,928

(22) PCT Filed: Apr. 14, 2003

(86) PCT No.: PCT/NO03/00121

§ 371 (c)(1),
(2), (4) Date: Sep. 12, 2005

(87) PCT Pub. No.: WO2004/090278

PCT Pub. Date: Oct. 21, 2004

(65) Prior Publication Data

US 2006/0185905 A1 Aug. 24, 2006

(51) Int. Cl.
*E21B 17/07* (2006.01)

(52) U.S. Cl. ..... 175/325.3; 175/321; 175/323

(58) Field of Classification Search ..... 175/323, 175/102, 310, 388, 101, 106, 322
See application file for complete search history.

(56) References Cited

U.S. PATENT DOCUMENTS

| | | | | |
|---|---|---|---|---|
| 3,871,193 | A * | 3/1975 | Young | 464/21 |
| 3,963,228 | A * | 6/1976 | Karle | 267/166 |
| 4,133,516 | A * | 1/1979 | Jurgens | 267/125 |
| 4,276,947 | A * | 7/1981 | Hebel | 175/321 |
| 4,323,128 | A * | 4/1982 | Young | 175/57 |
| 4,394,884 | A * | 7/1983 | Skipper | 175/321 |

(Continued)

FOREIGN PATENT DOCUMENTS

EP 0 065 601 A1 12/1982

(Continued)

OTHER PUBLICATIONS

• International Search Report having a mailing date of Oct. 16, 2003.

*Primary Examiner*—Jennifer H Gay
*Assistant Examiner*—Cathleen R Hutchins
(74) *Attorney, Agent, or Firm*—Andrus, Sceales, Starke & Sawall, LLP

(57) ABSTRACT

A dynamic damper for installation in a drill string (1), the purpose of which damper is to reduce the risk of jamming the drill bit (5), thereby avoiding damages in the event of unwanted extreme oscillations and rotational speed of the drill string caused by uncontrolled release of torsional energy in the drill string when the drill string suddenly breaks free of the jam. For this purpose, the damper is constructed from an outer and an inner string section (11) and (12), supported concentrically and interconnected through a helical threaded connection (10), so that relative rotation between the sections caused by torque (8) will give an axial movement that lifts and loosens the drill bit from the bottom of the hole in critical jamming situations. The spring (9) maintains the outer string section in an axial position against the shoulder (22). A hydraulic damping effect on the axial movements is achieved by oil volumes (16) and (17) being interconnected through narrow bores (18). Logging of the damping function is carried out by sensor (20), which registers and stores data to be read when the damper is retrieved to the surface.

7 Claims, 3 Drawing Sheets

U.S. PATENT DOCUMENTS 4,434,863 A * 3/1984 Garrett ..... 175/321
4,439,167 A * 3/1984 Bishop et al. ..... 464/20
4,443,206 A * 4/1984 Teng ..... 464/20
4,466,496 A * 8/1984 Jones ..... 175/67
4,779,852 A * 10/1988 Wassell ..... 267/125
4,901,806 A * 2/1990 Forrest ..... 175/321
5,323,852 A * 6/1994 Cornette et al. ..... 166/51
6,308,940 B1 * 10/2001 Anderson ..... 267/125
2001/0045300 A1 * 11/2001 Fincher et al. ..... 175/26
2004/0129457 A1 * 7/2004 McNeilly ..... 175/57

FOREIGN PATENT DOCUMENTS

GB 2339223 B * 10/2001
WO WO 98/40600 A1 9/1998
WO WO 9840600 A1 * 9/1998

* cited by examiner

DYNAMIC DAMPER FOR USE IN A DRILL STRING

CROSS REFERENCE TO RELATED APPLICATION

The present application is the U.S. national stage application of International Application PCT/NO2003/000121, filed Apr. 14, 2003, which international application was published on Oct. 21, 2004 as International Publication WO 2004/090278.

BACKGROUND OF THE INVENTION

This invention regards a dynamic damping device for use in a drill string, designed especially for use when drilling for hydrocarbons in sedimentary rocks.

Known dynamic dampers are extensively used to dampen oscillations that arise in mechanical constructions subjected to variable loads. In a drill string having a length of several thousand metres, oscillations can arise as a result of variations in the torque along the drill string.

Variations in torque may be due to different frictional conditions along the string and drilling through formations of different hardness, causing the moment on the drill bit to vary. Such uncontrollable variations in torque will in turn generate oscillations that exert great forces and vibrations on the drill string, in particular when the oscillations resonate with the natural oscillations of the drill string.

The use of more modern and more powerful rotary machines over the last years has resulted in the drill string now being subjected to considerably greater strain, with a consequent increase in the risk of damage caused by uncontrolled oscillations and vibrations.

A particular problem arises when the drill bit hits a formation that is difficult to penetrate, and jams. The drill string is turned by torque from the drilling machine on the surface, and the string builds up energy which is released when the drill suddenly breaks loose. All the stored energy is released through uncontrolled rotation, and the lower part of the drill string may reach extreme rotational speeds that can cause damage to the drilling equipment. Today's controlled drilling systems include a lot of electromechanical equipment that is especially susceptible to damage when subjected to this type of strain.

SUMMARY OF THE INVENTION

In relation to prior art, the object of the invention is to provide a solution that reduces the risk of the drill bit getting jammed, and of accumulated energy stored as torque in the drill string being released in the form of uncontrolled rotation.

This is achieved in accordance with the invention, by a dynamic damper being installed in the drill string, above the measuring equipment used for directional control. This damper consists of an inner cylindrical string section with threads that connect this to the upper section of the drill string, which in turn is connected to the rotary machine on the surface. An outer cylindrical string section is supported concentrically on the inner string section and connected to a lower section of the drill string towards the drill bit, through a threaded connection. The outer and inner string sections are engaged through a spiral trapezoidal threaded connection, so that relative rotation between the string sections will cause a relative axial movement between the two parts. A spring is disposed between the outer and inner string sections and pre-tensioned, so that axial movement between the outer and inner string sections occurs only when axial force and moment or a combination of these exceed a predetermined value. Externally of the outer string section there is provided a cylindrical jacket connected to the inner string section through a threaded connection, such that the jacket protects the outer and inner string sections while at the same time constituting a limitation for the axial movement between the outer and inner string sections.

Between the outer and inner string sections there are two volumes filled with oil and interconnected in a manner such that axial movement will cause forced displacement of liquid from one volume to the next through narrow passages. This has an intended dynamic damping effect on the movement.

When the present invention is installed in a drill string, torque caused by incipient locking of the drill bit will effect relative rotation between the outer and inner string sections when the moment exceeds a selected spring tension. This will result in an axial movement that lifts and loosens the drill bit from the bottom. When the drill bit comes loose, the moment is reduced and the spring will again push the drill bit towards the bottom of the borehole, thus generating torque resistance that prevents the accumulated torque in the drill string from "spinning" out of control.

BRIEF DESCRIPTION OF THE DRAWINGS

The invention will now be explained in greater detail in connection with the description of an embodiment and with reference to the enclosed drawings, in which.

DETAILED DESCRIPTION OF THE INVENTION

Figure 1:
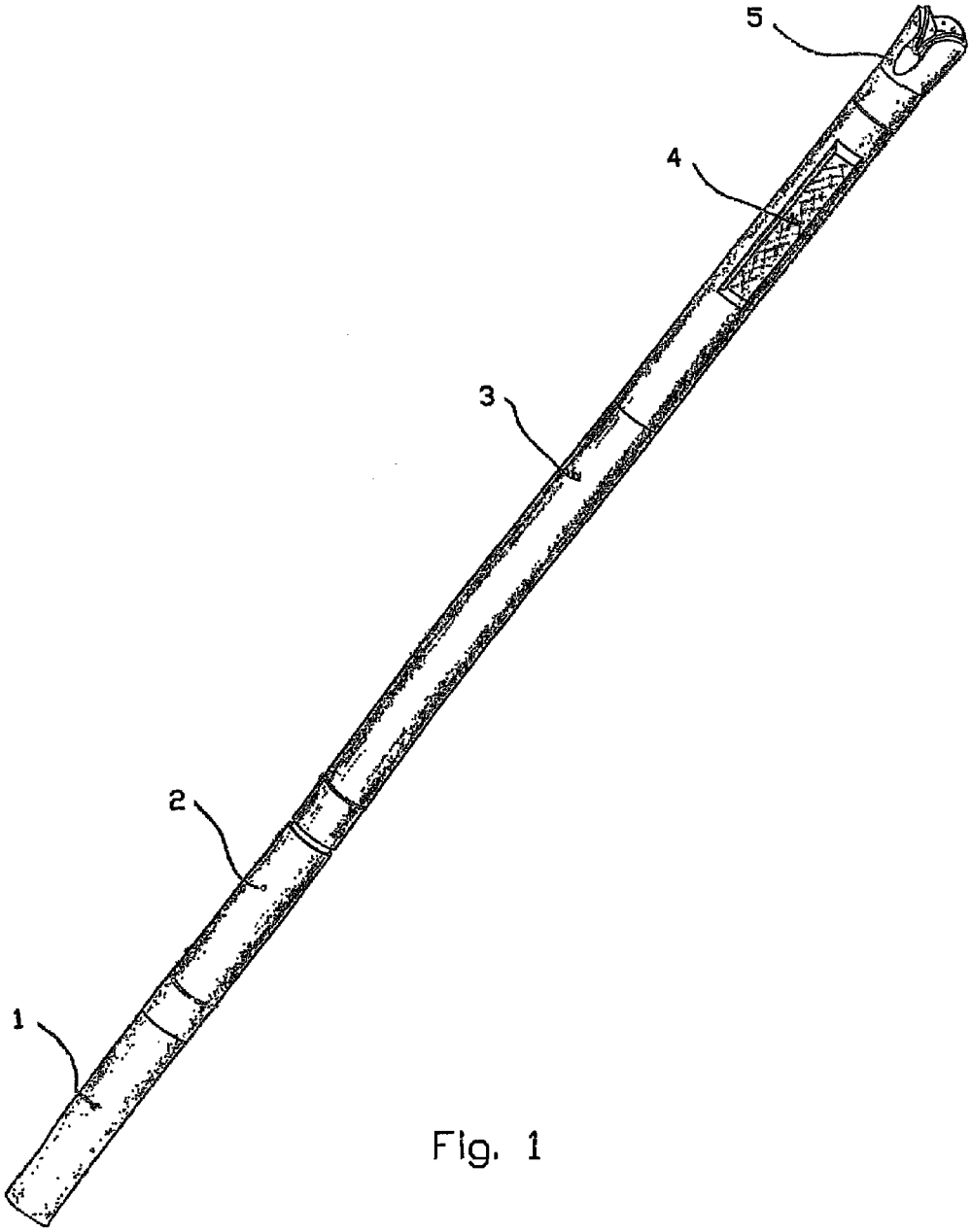
FIG. 1 is a system overview with a dynamic damper installed in the drill string.
Figure 2:
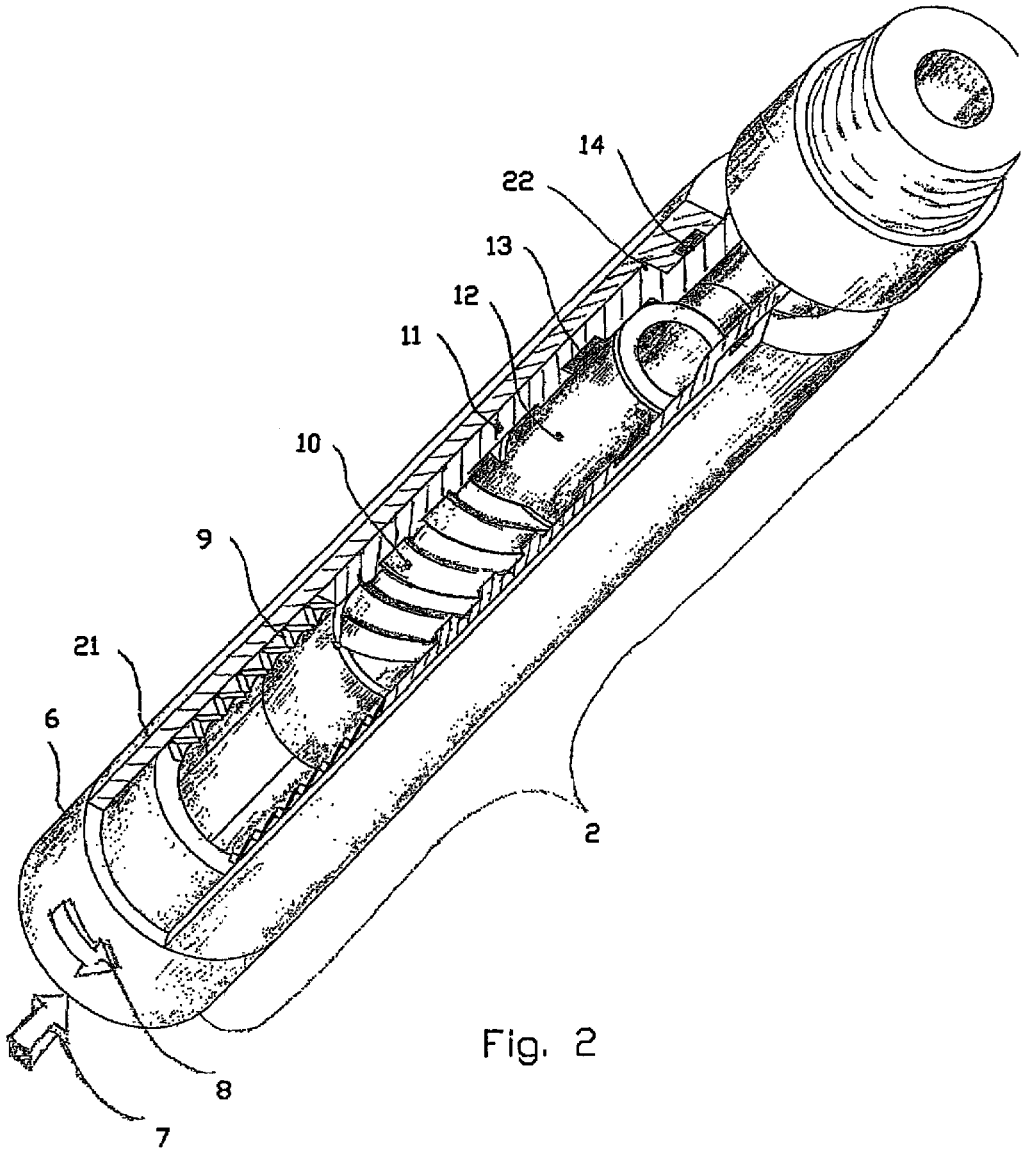
FIG. 2 shows a section through the outer string section.
Figure 3:
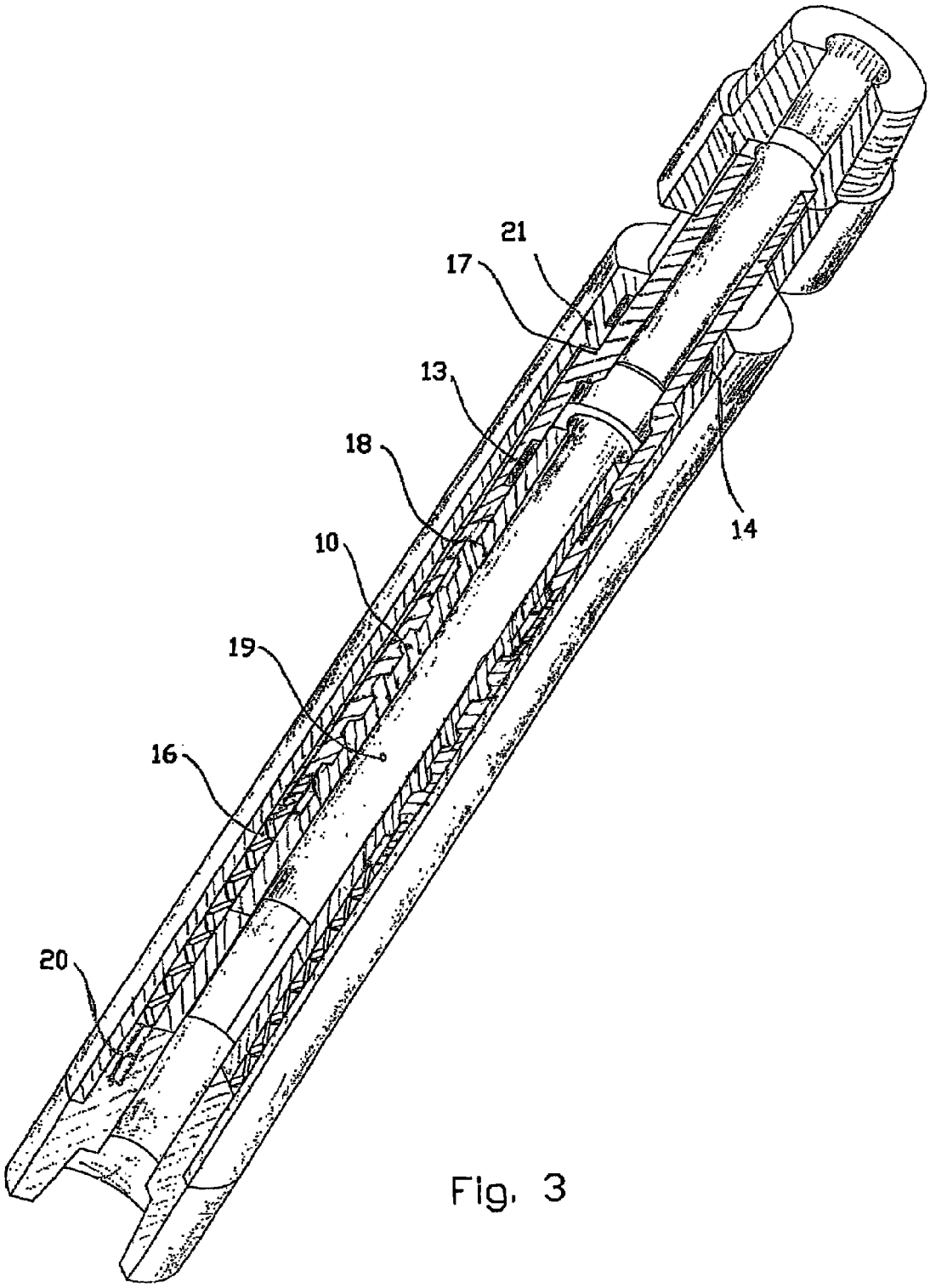
FIG. 3 shows a section through the outer and inner string sections.

In the drawings, reference number 1 denotes a known drill string where the dynamic damper has been installed and is referred to by reference number 2. The instrumentation section for directional control 3 is installed in an extension of the damper, towards the drill bit, while the extension of part 3 holds stabilizers nibs 4 and drill bit 5.

The torque and the axial force transferred to the damper are indicated by reference numbers 8 and 7. The end piece 6 attached to the drill string with a threaded connection transfers the forces to an inner string section 12.

The inner and outer string sections are engaged through helical threads 10, such that relative rotation of these parts will entail relative axial movement between the parts. A torsional spring 9 stops against the end piece 6 on the inner string section 12 and against the outer string section 11. The spring forces the outer string section 11 to stop against the shoulder 22 of outer jacket 21. Thus the outer string section 11 will be pre-tensioned between the spring 9 and the shoulder 22 in a manner such that the torque 8 combined with axial force 7 must exceed a given value before relative torsion between the outer and inner string sections will occur, causing the intended axial movement between these sections.

The cavity formed between the two string sections and the jacket 21 is filled with oil that is kept in place with respect to the surroundings by means of seals 13 and 14. Volume 17 and volume 16 around the spring 9 are interconnected through narrow bores 18, so as to bring about an intended damping effect on the axial movement.

A central bore 19 for drill mud passes through the inner and outer string sections.

In order to log the performance of the damper, a sensor 20 is provided to register and record data on oil pressure and spring force from the spring 9. These data can then be read when the drill string is retrieved, and will give information about the performance of the damper.

The invention claimed is:

1. A dynamic damper installed in a drill string above a drill bit, the damper comprising:

an inner cylindrical string section having an upper end connected to an upper portion of the drill string;

an outer cylindrical string section supported concentrically on the inner string section and having a lower end connected to a lower portion of the drill string;

wherein the inner and outer string sections are engaged via a spiral trapezoidal threaded section oriented so that relative rotation between the string sections will cause relative axial movement between the string sections;

a spring disposed between the inner and outer string sections, the spring being pre-tensioned so that axial movement between the outer and inner string sections occurs only when combined axial force and torque on the string sections exceed a predetermined value;

a cylindrical jacket arranged externally on the outer string section and connected to the inner string section such that the jacket protects the inner and outer string sections and constitutes a limitation for axial movement between the inner and outer string sections;

two oil-filled volumes located between the inner and outer string sections and being connected such that relative axial movement of the inner and outer sections forces displacement of oil from one of the volumes to the other volume, thus dampening movement between the string sections;

wherein torque caused by locking of the drill bit attached to the lower portion of the drill string effects relative rotation between the inner and outer string sections when said torque exceeds a selected spring tension;

wherein said relative motion between the inner and outer string sections is an axial movement that lifts and loosens the drill bit from its locked position;

wherein said lifting and loosening of the drill bit reduces said torque such that the spring tension pushes the drill bit in a direction away from the damper.

2. The dynamic damper of claim 1, wherein the spring is a torsion spring that has one end stopped against the inner string section and another end stopped against the outer string section.

3. The dynamic damper of claim 2, wherein the torsion spring forces the outer string section to stop against a shoulder of the outer jacket such that the outer string section is pre-tensioned between the spring and the shoulder in such a manner that the torque combined with the axial force must exceed a predetermined value before relative movement between the inner and outer string sections will occur.

4. A dynamic damper installed in a drill string above a drill bit, the damper comprising:

an inner cylindrical string section having an upper end connected to an upper portion of the drill string;

an outer cylindrical string section supported concentrically on the inner string section and having a lower end connected to a lower portion of the drill string;

wherein the inner and outer string sections are engaged via a spiral trapezoidal threaded section oriented so that relative rotation between the string sections will cause relative axial movement between the string sections;

a spring disposed between the inner and outer string sections, the spring being pre-tensioned so that axial movement between the inner and outer string sections occurs only when combined axial force and torque on the sections exceed a predetermined value;

wherein the spring is a torsion spring that has one end stopped against the inner string section and another end stopped against the outer string section;

wherein torque caused by locking of the drill bit attached to the lower portion of the drill string effects relative rotation between the inner and outer string sections when said torque exceeds a selected spring tension;

wherein said relative motion between the inner and outer string sections is an axial movement that lifts and loosens the drill bit from the drill bit's locked position;

wherein said lifting and loosening of the drill bit reduces said torque such that the spring tension pushes the drill bit in a direction away from the damper.

5. The dynamic damper of claim 4, comprising a cylindrical jacket arranged externally of the outer string section and connected to the inner string section such that the jacket protects the outer and inner string sections and constitutes a limitation for axial movement between the outer and inner string sections.

6. The dynamic damper of claim 4, comprising two oil-filled volumes located between the inner and outer string sections and being connected such that relative axial movement of the inner and outer sections forces displacement of oil from one of the volumes to the other volume, thus dampening movement between the sections.

7. The dynamic damper of claim 5, wherein the torsion spring forces the outer string section to stop against a shoulder of the cylindrical jacket such that the outer string section is pre-tensioned between the spring and the shoulder in such a manner that the torque combined with the axial force must exceed a predetermined value before relative movement between the inner and outer string sections will occur.

* * * * *

UNITED STATES PATENT AND TRADEMARK OFFICE

CERTIFICATE OF CORRECTION

PATENT NO. : 7,578,360 B2
APPLICATION NO. : 10/548928
DATED : August 25, 2009
INVENTOR(S) : Per Olav Haughom It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 545 days.

Signed and Sealed this

Seventh Day of September, 2010

David J. Kappos

David J. Kappos
*Director of the United States Patent and Trademark Office*